US007311682B2

(12) United States Patent
Mahan

(10) Patent No.: US 7,311,682 B2
(45) Date of Patent: Dec. 25, 2007

(54) MASSAGE TABLE FOR ADJUSTING SPINAL AREA

(76) Inventor: James D. Mahan, 1328 Westbrook Ave., Odessa, TX (US) 79761

( * ) Notice: Subject to any disclaimer, the term of this patent is extended or adjusted under 35 U.S.C. 154(b) by 729 days.

(21) Appl. No.: 10/609,155

(22) Filed: Jun. 26, 2003

(65) Prior Publication Data

US 2004/0002668 A1 Jan. 1, 2004

Related U.S. Application Data

(60) Provisional application No. 60/391,765, filed on Jun. 26, 2002.

(51) Int. Cl.
*A61H 1/00* (2006.01)

(52) U.S. Cl. ..... 601/49; 601/51

(58) Field of Classification Search ..... 601/49–54
See application file for complete search history.

(56) References Cited

U.S. PATENT DOCUMENTS 1,683,025 A 9/1928 Dallam
2,175,614 A 10/1939 Redfield
2,577,646 A 12/1951 Cameron
3,628,528 A 12/1971 Roberts
3,640,272 A 2/1972 Hussey
4,011,862 A 3/1977 Kosiak
4,085,738 A * 4/1978 Kodera ..... 600/557
4,699,126 A 10/1987 Lancaster
5,103,808 A 4/1992 Iams
5,167,225 A * 12/1992 Cheng-I ..... 601/112
5,311,860 A * 5/1994 Doria ..... 601/103
5,676,637 A * 10/1997 Lee ..... 601/15

* cited by examiner

*Primary Examiner*—Michael A. Brown
(74) *Attorney, Agent, or Firm*—Marcus L. Bates

(57) ABSTRACT

A physical therapy apparatus having a padded top surface upon which a patient comfortably reclines in the face up position with the spinal area being placed in contact respective a plurality of massaging members. The massaging members are recessed within the padded top and have a massaging members extending into contact with the patients back while jointly moved along the spine with the members being individually rapidly oscillated in a circular pattern at a selected magnitude of pressure and rate of travel. At the same time, the massaging members are moved a limited length along the entire spine causing each to describe a longitudinally moving circular pattern of a spiral, with each massaging member describing a different size pattern with the member that contacts the uppermost part of the spinal column moving within a relatively small pattern while the massaging members that contact the lower part of the spinal column move within a relatively large pattern with the pattern of movement progressively increasing sequentially from one to the other end of the spinal column. The terminal ends of the massaging members each are elevated into contact with the spine and assume a curve approximating the curvature of the spinal area so that a patient reclining in a supine position will gravitate into proper contact with all of the massaging members.

13 Claims, 4 Drawing Sheets

11
245
145
45
20
20
44
43
40
42
5
41
141
5
46
48
26
236
47
50
38
238
138
52
140
136
140
36
236
56
134
34
54
133
32
33
31
28
29
62
129
60

MASSAGE TABLE FOR ADJUSTING SPINAL AREA

CROSS-REFERENCE TO RELATED APPLICATIONS

PROVISIONAL APPLICATION FOR: "SPINE-O-VATION"
Ser. No. 60/391,765
FILED: Jun. 26, 2002
FOR INVENTOR: JAMES D. MAHAN

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Many people have discovered that their medical problems often can be solved by obtaining help from trained personnel, such as masseurs, athletic trainers and chiropractors to massage the spinal areas along the length of the spinal column. These trained professionals have knowledge of many manual techniques that can be applied to one's back, using the hands and fingers. Accordingly, various massage machines have been developed for manipulating and flexing the back muscles on both sides of the spinal column of a person lying in a supine position such as seen, for example, in U.S. Pat. No. 2,175,614. This patent discloses a machine having a plurality of rollers that are each supported by coil springs arranged along each side of a carriage that is movably mounted on tracks arranged to move along the spinal area. The carriage is moved back and forth along its tracks so that the rollers engage and massage the back of the person lying face-up on a hammock suspended above the rollers but with the rollers being in contact with the spinal area.

U.S. Pat. No. 2,577,646, also discloses a massaging machine having a horizontal table that accommodates a person lying face-up on the table with his spine centered over an elongated longitudinal opening in the central portion of the table. A plurality of rollers are rotatably mounted to the edges of parallel endless belts arranged below the surface of the table within the opening. The belts drive the rollers to move along the length of the elongated opening and thereby contact the spine with a rolling action to the spinal area of the person lying on the table.

U.S. Pat. No. 3,640,272 discloses therapeutic traction applied to the body by carriages supported on rails for cyclic longitudinal movement.

Further, U.S. Pat. No. 4,011,862 shows another massaging machine which includes two sets of rollers having ends positioned to provide an upwardly-facing concavity for receiving the back of a person as the rollers are moved along each side of the spinal column of that person.

U.S. Pat. No. 4,085,738 is a disease testing apparatus for the spine and is cited to show an arrangement of pressure members 64, as seen in FIG. 8 thereof, for example.

Another prior-art massaging apparatus arranged to impart upward and downward movements to a massaging device is seen in U.S. Pat. No. 1,638,025. This massaging apparatus includes elongated bars that are operatively journaled at their ends to rotate and move the bars about parallel longitudinal axes, with there being curved portions of the bars transversely aligned and the ends of a plurality of closely-spaced slats are loosely connected to the bars to support a person midway between the bars. As the bars rotate, the slats remain horizontal and move vertically for imparting a rocking and undulating motion to the back of a person lying on the slats.

U.S. Pat. No. 3,628,528 shows a machine with a single horizontal roller mounted on a carriage that is moved to selectively position the roller below a person's back area that requires a massaging action. The roller is rotatably mounted between spaced vertically-movable members and reciprocated by cranks mounted in an out-of-phase relationship on opposite ends of a rotating shaft, whereupon rotation of the shaft rocks the roller in a vertical plane as the opposed ends alternately move up and down by the members.

U.S. Pat. No. 5,163,808 applies cyclic thrusting force against the back of a person by the use of thruster members around one or more vertebra of the spinal column, as shown in FIG. 3 at 201, 202 and 203. Fluid cylinder 300 reciprocates the rod 200 longitudinally to engage the back with the round members at 260, 261 and 262.

By the present invention, there is made available an improved massaging machine, made in accordance with the present invention, which is capable of imparting a selected massaging action to a multiplicity of areas adjacent the spinal column on the back of a person in a new and different manner. The resultant massaging action provides unexpected beneficial results that would be difficult to manually duplicate by most trained professionals. This desirable massaging treatment is achieved by the provision of an array of massaging thrusters, each having a massaging fixture attached thereto and having a massaging members depending there-from for engaging both sides of the spinal column at the same time with an unusual motion that commences in proximity of the lower spinal column where a relative large circular motion is imparted to the massaging member; and terminates at the head end of the spinal column where a relative small circular motion is imparted to the massaging members contacting the back. At the same time, the array of thrusters are all moved up and down longitudinally of the spinal column at a low rate of travel respective to the rate of rotation imparted into each of the thrusters. Accordingly, the combination of the reciprocating movement and the circular movement provides a resultant motion that describes a spiral pattern commencing with a large diameter spiral in the lower spinal region and progressively diminishes along the spinal column towards the head.

The thrusters are resiliently biased into engagement with the spinal area with an adjustable force that include means for selecting the magnitude of the force of the engaging massaging members.

An unexpected advantage of this method and apparatus of mechanically massaging a persons back in the area of the spinal column is realized from an apparatus made in accordance with this invention. The geometry of the thrusters together with the supporting structure and the complex pattern of movement described by the thrusters induce a harmonic motion into the resiliently biased thrusters which is translocated to the interface between the skin of the back and the massaging member whereby unexpected low friction engagement is realized while the longitudinal and circular moving massaging members bear against the skin, which is very desirable for it enhances the therapeutic value of the massaging action of the massaging apparatus.

Method and apparatus for achieving the above desirable results is made possible by the provision of an apparatus made in accordance with the present invention as will be more fully realized when this disclosure is more fully digested.

BRIEF SUMMARY OF THE INVENTION

In the preferred embodiment of this invention, a table mounted apparatus massages the back of a person in a new and different manner that provides unexpected results. The term "massage" as used herein, is intended to include kneading, tapping and otherwise manipulating the area proximate to the spine. Massaging the area located on each side of the back adjacent the spine induces relaxation and comfort while conditioning a person for further chiropractic treatment. Additionally, the massage treatment provided by this invention is a superior substitute that is available to a skilled chiropractor, and when the advantages of the invention are coupled with the work of the chiropractor, the resultant treatment provides a synergistic system because the chiropractor is relieved of the time consuming massage duties and therefore can conserve and direct all his efforts towards improvement of the patient, while the patient derives a more extensive treatment at a lower cost.

This desirable result is achieved by the provision of a massaging table having an upwardly opening chamber or groove, longitudinally disposed respective the table top. Within the opening there are mounted a multiplicity of vertical movable thrusters, typically 8 to 16, that work automatically to adjust to the contour of patient's back. The pressure of the vertical thrusters can be regulated to control the force exerted on the patient's back. The thrusters are rapidly moved within a horizontal plane to describe small circles which are relatively small at the head end of the spine and grow progressively larger toward the foot end. At the same time the thrusters are moved more slowly longitudinally of the spinal column, thus this combination of thruster motion provides a unique spiral-like massaging action sequentially changing along the entire spine. The horizontal movement of the thrusters as well as the vibration intensity to the patient's back can be varied.

Accordingly, a primary object of the present invention is the provision of a method and apparatus for massaging the back with an array of massaging elements that manipulate the muscles of the back with variable intensity commencing with the greatest intensity occurring in proximity of the lower spinal column where a relative large circular motion is imparted to the massaging member; and terminates at the head end of the spinal column where a relative small circular motion is imparted to the massaging members contacting the back, and at the same time, the array of thrusters are all moved up and down longitudinally of the spinal column at a slow rate of travel respective to the rate of circular motion or speed imparted into each of the thrusters.

Another object of the present invention is the provision of improvements in massaging apparatus by the provision of a massaging table having an upwardly opening chamber or groove longitudinally disposed respective the table top; within the opening there are mounted multiple pairs of movable vertical thrusters that work automatically to adjust to the contour of patient's back whereby the pressure of the vertical thrusters can be regulated to reduce or increase the force exerted on the patient's back.

A further object of this invention is the provision of multiple thrusters mounted for rapidly moving within a horizontal plane to describe small circles against the spine and wherein the circles grow larger from the head to the foot end of the spinal column; while at the same time the thrusters are moved longitudinally along the spinal column with the horizontal movement of the paired vertical thrusters being varied in the amount of forward and reverse travel or motions.

A still further object of this invention is the provision of an array of back engaging thrusters that are individually mounted on a vibrator bar and can be variably adjusted to increase or decrease the vibration intensity to the patient's back so that all motions respective the intensity of the massaging action can be selected as desired.

Another and still further object of this invention is the provision of massaging apparatus and method by which the geometry of a plurality of thrusters together with the supporting structure thereof are moved while vibrating in a horizontal plane to provide a complex massaging pattern of movement which additionally induces a harmonic motion into the resiliently biased thrusters which enables low friction engagement to be realized at the interface between the massaging members and the back as the members bear against the skin.

These and other objects and advantages of the present invention will become readily apparent to those skilled in the art upon reading the following detailed description and claims and by referring to the accompanying drawings.

The above objects are attained in accordance with the present invention by the provision of an improved method of massage treatment and apparatus fabricated in a manner substantially as described herein.

BRIEF DESCRIPTION OF THE SEVERAL VIEWS OF THE DRAWINGS

Three sheets of drawings containing 9 Figures are included in this application, of which are seen.

DETAILED DESCRIPTION OF THE INVENTION

Figure 1:
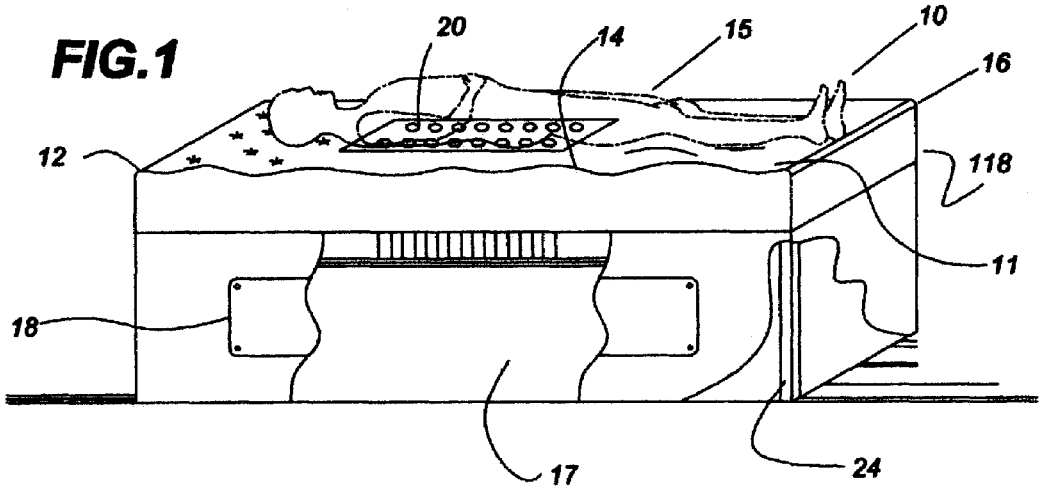
FIG. 1 is a perspective view of a massage table made in accordance with this invention, with some parts thereof being removed to disclose the interior.

Referring to the Figures of the drawings and particularly to FIG. 1, a massage table 10 is seen illustrated that has a top or uppermost surface 11 of leather or vinyl cover with suitable padding. The uppermost surface 11 of table 10 includes a head portion 12, a hump portion at 14 to accommodate the small of the back, and a leg portion 16. An area is referred to as shoulder portion 120, because with a person 15 lying on table 10, his shoulder 120 would be about in that area. Also, with a person lying on the table, there may be seen that the small of his back would be on hump 14 while his feet and legs would extend to the portion identified as leg portion 16. This configuration of surface 11 of table 10 is desired because a person, when reclining on table 10, will naturally position himself in this most desirable manner to properly orient his spinal column respective to the massaging apparatus 17 associated with table 10, and described herein, in accordance with this invention.

Figure 2:
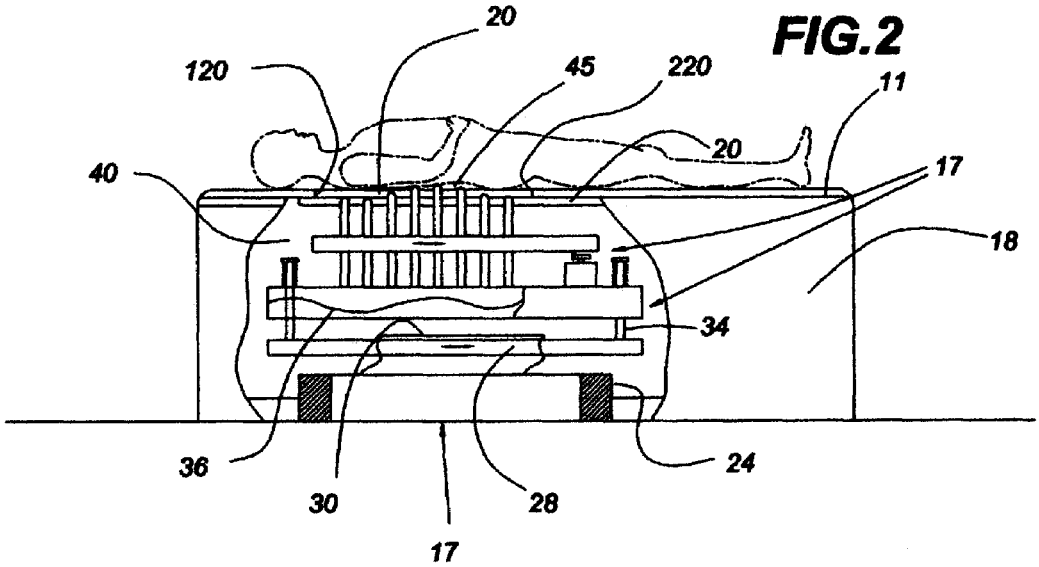
FIG. 2 is a part diagrammatical, part schematical, part cross-sectional side view illustrating a preferred embodiment of the invention.
Figure 2A:
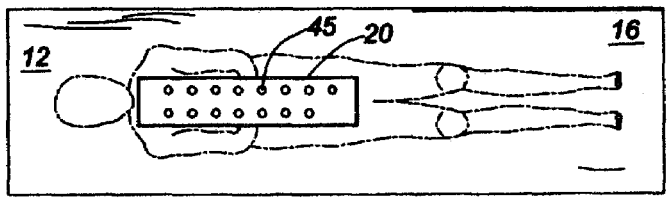
FIG. 2A is a plan view of the foregoing figures.
Figure 3:
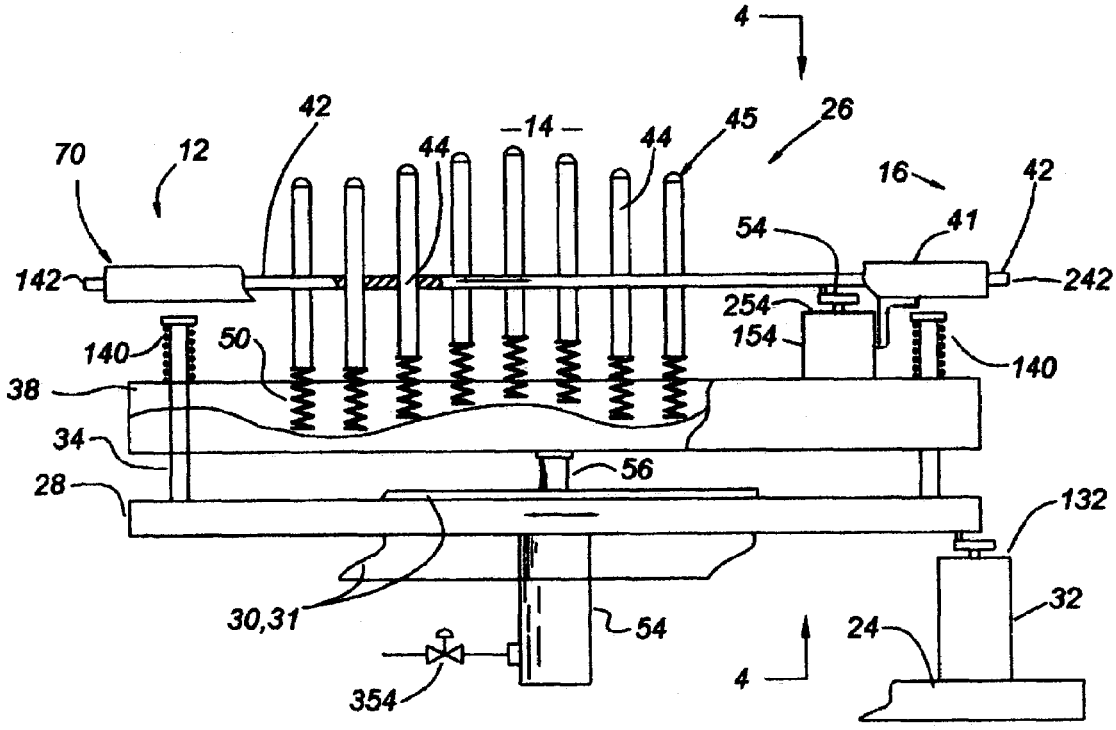
FIG. 3 is a part diagrammatical, part schematical, part cross-sectional enlarged detailed view illustrating the preferred embodiment of the invention.

Looking now to FIG. 2, in conjunction with FIGS. 1 and 3, it will be noted that midway between the sides 18, 118 of table 10 is a groove, or upwardly opening recess 20, formed within the top surface 11 of table 10 in communication with the interior. This groove 20 is seen to extend longitudinally along the table from shoulder portion 120, across hump portion 14, and terminates beyond a buttocks portion 220 so that the entire spinal area is accessible through the groove 20. The upwardly opening groove communicates with the interior such that the massaging apparatus 17 has the upper part thereof partially extending through the groove 20 into contact with a person resting face-up on the table surface 11, as illustrated by numeral 14 of FIGS. 1 and 2.

A main frame 24 supports most all of the elements of this invention 18, including the table surfaces 11 as well as a vibrating unit 26, made in accordance with this invention and as disclosed in greater detail in other figures of the drawings.

Figure 5:
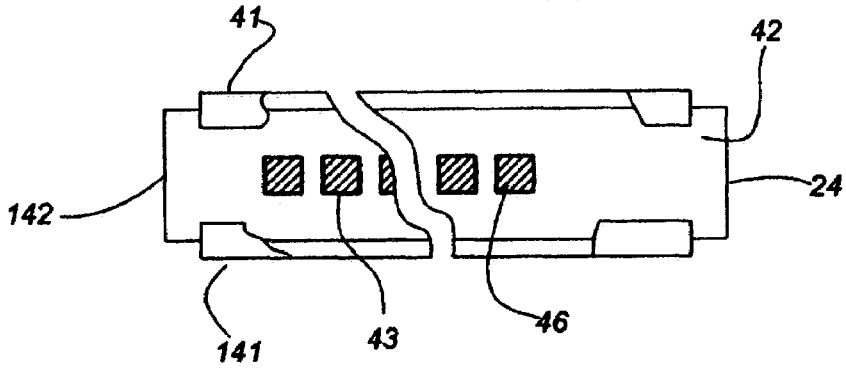
FIG. 5 is a fragmentary top view of part of the apparatus seen in FIGS. 3 and 4.

As seen in FIGS. 2 and 3, together with other figures of the drawings, a base plate 28 is mounted for horizontal fore and aft movement respective to a pair of opposed base plate bearing slides 30, 31. The bearing slides 30, 31 are supported by main frame 24 to permit base plate 28 to slidably move horizontally along its longitudinal axis for a distance of at least 4 inches (see FIGS. 4 and 5). Hence, base plate 28 is slidably captured for limited fore and aft movement whereby it continually reciprocates back and forth along the opposed bearing slides 30, 31, which is along a path parallel to groove 20. Base plate motor 32 is attached to frame 24 and can take on a number of different forms so long as it is geared or otherwise arranged to rotate a crank that has a crank pin off-set 2 inches to effect longitudinal movement of 4 inches. The radius of 2 inches can be changed to reciprocate base plate 28 other lengths, as desired. The movement of base plate 28 is preferably confined to a range of approximately 6 or 12 reciprocation each minute, which is to say, a cycle that is adjustable within a range of 5 or 10 seconds.

Figure 4:
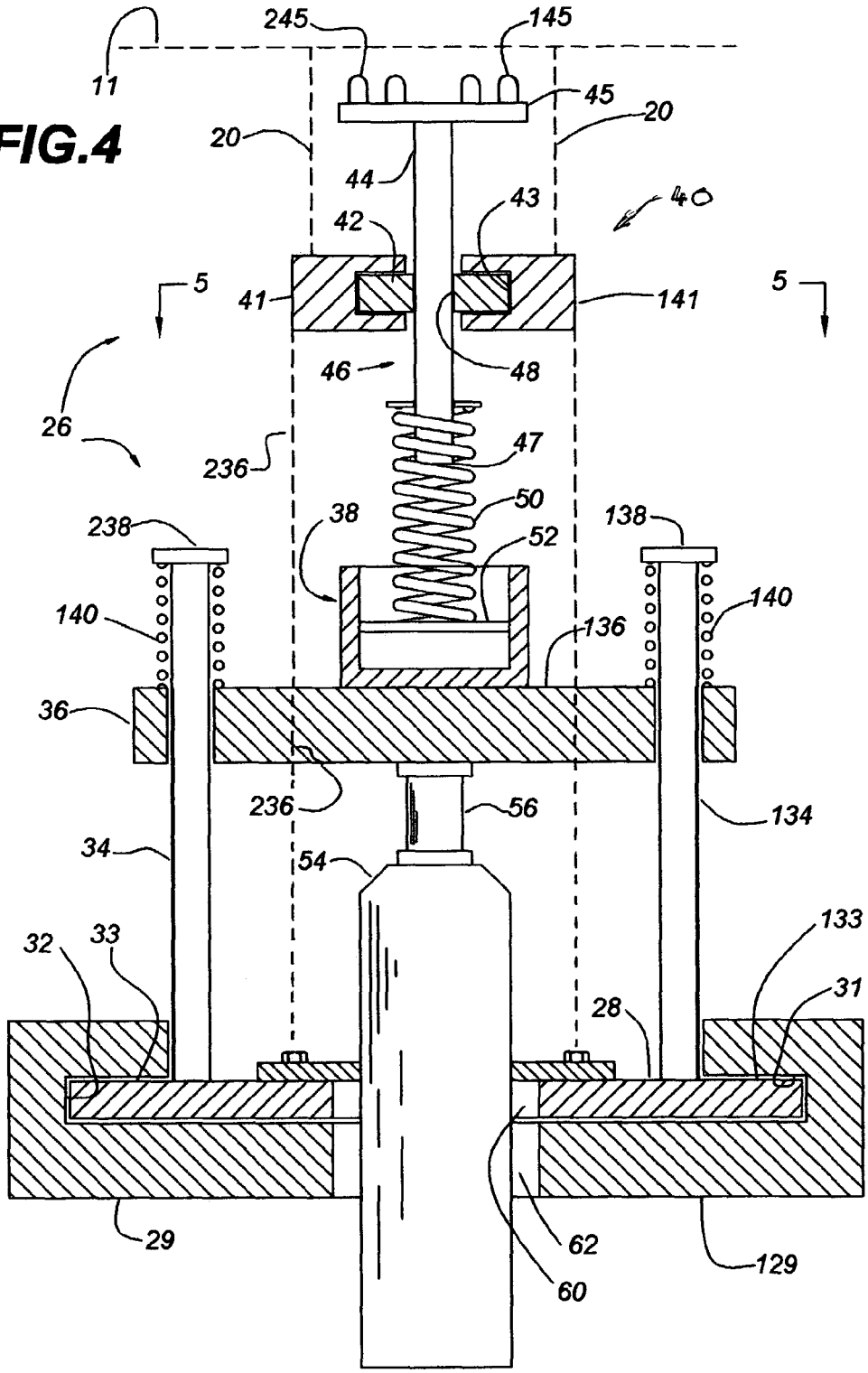
FIG. 4 is an enlarged part cross-sectional view taken along line 4-4 of FIG. 2.

In FIG. 4, the bearing slides 31, 32 are formed within the illustrated main support member 29 and are suitably attached to the main frame 24 (FIGS. 1 and 2) to enable the entire vibrating massage apparatus 26 to be properly supported in a structurally acceptable manner.

Hence, base plate 28 is slidably received within slide bearings 31, 32 of main support member 29 and is located beneath top 11 of table 10. The slide bearings 31, 32 are in the form of the illustrated confronting inwardly opening slots formed within member 29, and thereby capture the opposed marginal edges 33, 133 of baseplate 28 therewithin, with main support member 29 being positioned within the interior of table 10 and in underlying relationship respective to a person's back. Main support member 29 is the lowermost member of vibrating unit or apparatus 26 and is rigidly attached to main frame 24. The motor 32, having a gear box 132, rotatably drives a crank at the end of its output shaft. Motor 32 is rigidly mounted respective frame 24 or main support member 29 and is connected to reciprocate base plate 28 so that base plate 28 moves longitudinally respective groove 20. The length of the crank attached to the output shaft is selected to provide the desired stroke length in the same manner seen illustrated at numerals 52, 54, 56 of FIGS. 7, 8 and 9, as will be more fully described later on herein.

As further illustrated in FIG. 4, together with other figures of the drawings, elevating member 36 has formed therein perpendicular bores that slidably receive a medial length of several vertical guide members 34, 134 therethrough for properly positioning of elevating member 36 respective the vibrating mount assembly 40 that also is supported from the base plate 28 that underlies elevating member 36 as suggested by numeral 236. A guide bushing fitted within a bore formed perpendicular through each corner of elevating member 36 is provided for proper alignment and weight distribution of the imposed loads and is comprised of return springs 140, 240 captured between abutment 138, 238 and upper surface 136 of elevating member 36, along with vibrator mount assembly 40 connected by suitable support 236 as well as the load presented by compressed spring 50.

Base plate 28 supports an elevating member 36 having a spring board 38 rigidly attached thereto and lies in underlying relationship respective a vibrating mount assembly 40, which will be more fully discussed later on herein. Hence, the vibrator mount assembly 40 is positioned in supported relationship above elevating member 36 and base plate 28 to move the vibrator mount assembly 40 in unison with base plate 28.

Still looking at FIG. 4, in conjunction with other figures of the drawings, the vibrator mount assembly 40 includes an elongated vibrating member 42 which supports and guides a multiplicity of spaced thrusters 44, and, for purposes of illustration, there are thirteen thrusters 44, each having a splined shaft 46 (shown square in cross-section) received within complementary apertures 48 (shown as square apertures) formed perpendicularly respective the vibrating member 42. Each of the apertures 48 reciprocatingly receive the splined rectangular shaft 46 of thrusters 44. The rectangular shaft 46 of thrusters 44 extends through the complimentary apertures 48 so that rectangular shaft 46 remains properly oriented in indexed relationship respective a person's spinal column. That is, fixture 45 is positioned laterally respective a person's spine to dispose protrusions 145, 245 in a working area on opposite sides of the spine.

The thrusters 44 are actuated vertically when pushed upward by biasing means in the form of springs 50. The lower end of the springs 50 are received in supported relationship by spring board 38. The member 52 forms a supporting surface for springs 50 along the interior of spring board 38 and is curved as it follows the contour of the upper surface of table 10, whereby springs 50 are supported to regulate the height of thrusters 44, and the back engaging fixture 45 closely follow the contour of the table surface, or the person's back, while at the same time spring board 38 is moved vertically a predetermined amount to concurrently lift all of the massaging elements 145, 245 into proper engagement with the spinal column area.

Therefore, the protrusions 145 that form the massaging elements are about the level with the table top 11 and follow this level throughout the curvature of the table. Hence, the springs are jointly simultaneously adjustable for selecting the ideal pressure that each of the protrusions 145 exert against the back of the person lying face-up on the table, with the protrusions 145 being separated or spaced apart from one another by a distance equal to the spacing of the illustrated apertures 48 as described above.

Figure 7:
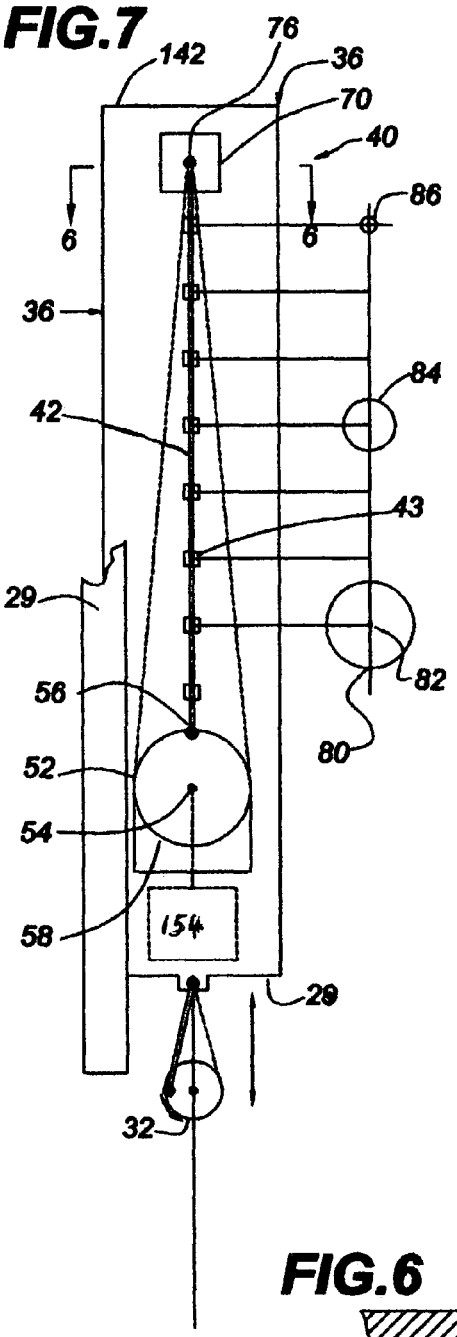
FIG. 7 is a top plan view of part of the apparatus of FIGS. 2, 3 and 4, and FIGS. 8 and 9 are schematical representations illustrating the geometry of part of the apparatus of the invention.
Figure 9:
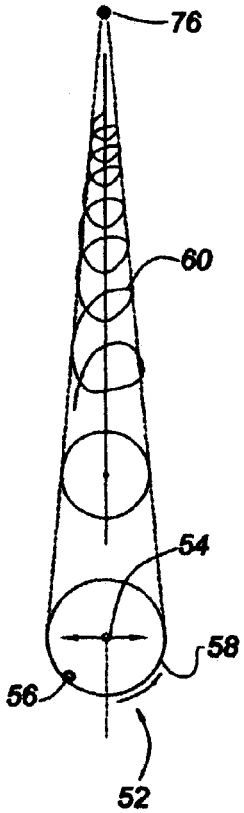
Figure 8:
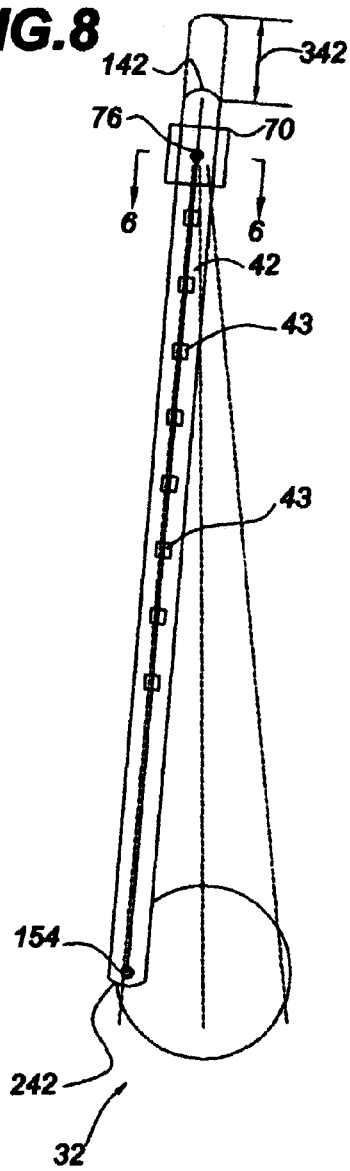

As seen in FIGS. 7, 8 and 9, the vibrator mount 42 is vibrated by a crank 52 that is rotated by motor 154 (see FIG. 3) having a shaft at 54 connected for rotating the crank 52 at a high rate of rotational speed. The foot end of the vibrating rod 42 is connected to a crank journal at 56 in a manner to be rotated approximately 1780 rpm thereby rotating the foot end of the vibrating rod 42 at the speed of the crank, which is a circle equal to the radius of the crank 52.

Figure 6:
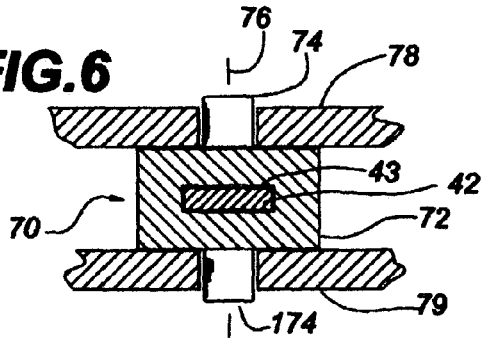
FIG. 6 is a fragmentary cross-sectional view taken along line 6-6 of FIGS. 7 and 8.

While crank 52 is vibrating the foot end of the vibrating bar 42 within the 0.2 inch radius circle, the head end of the vibrating bar 42 is reciprocatingly received at 43 within a bearing 70 seen in FIG. 6 which pivots along axis 76 to allow the 0.4 in stroke or oscillation while concurrently allowing the bearing to pivot within that range. Opposed mounting ears 74, 174 are received within members 78, 79 connected, for example, to the bearing slide in any reasonable manner.

In the illustration of FIGS. 7, 8 and 9, the geometrical pattern described by the protrusions 145 (FIG. 4) of the thrusters shaft 46 (see FIGS. 3 and 4) as they are moved by the vibrating bar 42 can be described as a spiral-like or a moving elliptical or circular figure as the thrusters are vibrated 1780 times a minute and while simultaneously traveling back and forth a total length of four inches in a fore and aft or reciprocating manner. Accordingly, this complex motion will be described as an oscillatory circular path or spiral 60 of FIGS. 7, 8 and 9 to avoid misdescription. At the foot end 16 of table 10, shaft 54 of motor 254 is connected to rotate the before mentioned crank 52 which is connected to move the foot end of the vibrating bar in a circle, in a manner as noted in FIG. 7 in order to reciprocatingly vibrate mount or bar 54. The crank arm is 0.2 inch in effective length, which describes a 0.4 diameter circle as it is revolved. The other end of vibrating bar 42 is reciprocatingly received within a bearing 70 (seen in FIG. 6) which is mounted to the head end of vibrating member 40 and is free to pivotally move about journals 74, 174 having an axis 76 while concurrently being reciprocated within bearing 70 as it moves in a horizontal plane. This universal action will cause the thrusters to reciprocate back and forth 1780 times a minute, which is a total of 3560 strokes/minute, there being two strokes for each cycle of the crank. The springs 50 bias or push the knobs against the flesh of the person receiving the treatment with spring pressure exerting no greater than 6 pounds for each fixture. The pressure exerted on the patient's back can be increased or decreased by adjustment of the compression of the springs. The spring pressure can each be adjusted individually, by selecting the curvature of the member 52 of FIG. 4, or by placing individual spacers between the lower ends of the spring. The spring pressure is adjusted during operation by the controlled movement of the illustrated springboard 38 by means of the pneumatic cylinder 54. It is preferred that the knobs 45 of the fixture do not press against the flesh of the back with more than 6 pounds applied at each shaft 46. As knobs 45 are moving against the body they will also be making a complete cycle of the 0.4 inch movement 30 times every second in addition to the longitudinal movement of 2 to 4 inches each 5-10 seconds. It will be remembered that the thruster movement near the legs will be describing a relatively large circle with a 0.20 inch radius, while the adjacent knobs cycle within a sequentially diminishing radius due to the forever changing geometry of the mechanism, as illustrated in FIGS. 7, 8 and 9.

The spring board 38 is elevated by air cylinder 54 having piston 56 thereof attached to a regulated source of pressure such as an air compressor (not shown). Spring board 38 is mounted to 36 and is moved vertically by Piston 56 with the vertical displacement being within an adjustable range of 3 or 4 inches in order to bring fixture 45 into proper contact with a person's flexible flesh. The spring pressure imposed on each fixture at fixture 45 is determined by the pneumatic pressure of the air cylinder 54, which elevates 36 to move 38 against 50 to thereby resiliently compress 50 and thereby bias shaft 46 with a constant upward force of about 6 pounds or less. As stated above, spring board 38 along with the base plate 28 are moved longitudinally by a crank about 4 inches at a rate of 6-12 reciprocation in one minute. During this time interval, springs 50 maintain all the springs of thrusters 44 simultaneously compressed or relaxed according to the pressure force each asserts against shaft 46.

The rapid vibration of vibrator bar 42 is transmitted into each thruster 44, causing each spring 50 to induce a harmonic motion therein, depending on how closely the vibrating mount assembly 40 is tuned to the oscillatory motion of the rotating crank. Hence, a maximum of a 6 pound compression between the vibrating shaft end and the stationary spring board 38 together with the horizontal vibration of vibrator bar 42 results in a minute vertical vibration which allows the knobs at 45 to move more freely against the skin with less friction than would otherwise be realized, thus allowing for low frictional contact between the constantly moving knobs 45 and the spinal area of the patient.

As described above, the vertical positioning of the spring board is achieved by air cylinder 54, which is controlled by throttling the flow from an air compressor (not shown). The vertical position of spring board 38 is controlled by vertical piston shaft 56 which extends from base plate 28, through a an aperture formed in spring board 56. Rod springs 26 placed around vertical support rods 29 force the spring board down when the pressure at air cylinder 53 is relaxed.

In operation, the patient lies on his back with his spinal column area superimposed over the array of knobs. The desired spring pressure is selected, the machine is energized, and the massaging treatment commences and continues for whatever length of time is deemed desired. An appropriate person can terminate the treatment by reducing the pressure when desired by changing the air regulator valve to the 54.

I claim:

1. Apparatus for massaging the spinal area of a person's back, comprising a table having a main frame and an upper surface for support of a person reclining in a supine position looking up; said table having a head end, a foot end, and opposed sides; an array of thrusters; each of said thrusters terminate in a back engaging fixture at an upper end thereof and having a lower end opposed to the upper end; said fixture includes spaced finger shaped protrusions depending therefrom and arranged to simultaneously engage and massage both sides of the spinal area;

said upper surface has an upwardly opening, longitudinally extending groove formed therein that is equal distant from the table sides through which said thrusters extend;

an elongated vibrating member for supporting and vibrating said thrusters, said vibrating member having opposed ends and positioned in underlying relationship respective said table surface for reciprocatingly receiving each of said thrusters which are arranged in spaced relationship along a medial length thereof to simultaneously bring said finger shaped protrusions into engagement respective both sides of the spinal area of the back, and biasing means at the lower end of each thruster;

an upper slide bearing reciprocatingly receiving a medial length of said vibrating member;

said opposed ends, respectively, of said elongated vibrating member are connected for movement between a crank means and a pivoted bearing means, respectively; and means for rotating said crank means to induce a rapidly reciprocating motion respective the longitudinal axis of the vibrating member while the longitudinal axis of each said thruster is moved in a circle about its vertical axis and of a magnitude whereby a vibratory sensation is effected respective the spinal area by rotating said crank means at a relatively high rate of rotation;

an elongated spring plate positioned in underlying relationship respective said elongated vibrating member for engaging the biasing means of the thrusters to elevate each of the finger shaped protrusions into a curved plane that coincides with the curvature of the spinal area, whereby, said spring plate simultaneously engages the spring end of each thruster to thereby resiliently bias the thrusters into engagement with both sides of the spinal area.

2. The apparatus of claim 1, wherein said spring plate is supported by a base plate, said base plate is slidably captured within lower slide bearings for fore and aft movement to thereby move the vibrating member and spring plate concurrently along a path parallel to the groove;

whereby the vibrating member, together with the base plate impart a longitudinal movement into the vibrating member to move said thrusters in a spiral pattern, thereby massaging the spinal area.

3. The apparatus of claim 2, and further including an elevating member arranged for movement towards and away from said vibrating mount assembly; the elevating means being supported by the base plate to position the thrusters at an elevation that biases the back engaging fixture against the spinal area with a predetermined force.

4. The apparatus of claim 1, wherein said vibrating mount assembly is supported by a base plate, said base plate is slidably captured within a lower slide bearings for fore and aft movement to thereby move the vibrating member and spring plate concurrently along a path parallel to the groove;

and further including an elevating member arranged for movement towards and away from said base plate; and elevating means supported by said base plate to position the thrusters at an elevation that biases the back engaging fixture against the spinal area with a predetermined force;

whereby, the vibrating mount assembly together with the base plate impart a movement into the thrusters that effect a spiral pattern along the spinal area.

5. A massage table having an interior, a top surface of a curved configuration for receiving a reclining person looking up; and, an array of thrusters each having opposed ends with there being a back engaging fixture attached to one end thereof to simultaneously engage and massage both sides of the spinal area;

an upwardly opening longitudinally extending groove formed within the top surface through which said thrusters may ajustably extend towards a person's back;

a vibrating member positioned below the top surface in alignment with the spinal area, with the thrusters being positioned within the groove and the fixture extended into contact with respect to the back; a lower bearing slide supported respective said table, a longitudinally extending base plate slidably supported in low friction relationship respective said lower bearing slide for reciprocating longitudinally of the spine;

a spring board spaced from said base plate and connected to be moved vertically respective said base plate and said vibrating member and to be reciprocated longitudinally by said base plate; elevating means connected to said base plate to selectively change the spaced apart relationship between said spring board and said base plate; while the vibrating member is supported respective the lower bearing slide for the base plate;

said vibrating member having opposed ends, guide means formed in spaced relationship along said vibrating member, said array of thrusters being spaced from one another, said opposed ends of said thrusters forming a medial length thereof reciprocatingly received within said guide means of said vibrating member;

said thrusters having a spine engaging end opposed to an actuating end by which the fixtures of the thrusters are resiliently forced into contact with the spinal area and reciprocated responsive to said vibrating member;

the head end of said vibrating member being supported by a journal means for reciprocal and pivotal movement with the opposed end thereof being moved with circular movement; whereby, said thrusters are moved in a circle at a relatively fast rate of movement which imparts a vibrating sensation in the back while simultaneously the thrusters move longitudinally at a relatively slow rate of speed.

6. The apparatus of claim 5 wherein said vibrating member is supported by the elevating member which in turn is supported by an expansible chamber which in turn is supported by the base plate, said base plate is slidably captured within slide bearings supported by the table for fore and aft movement to thereby move the elevating member which moves said spring plate and thrusters concurrently along a path parallel to the groove;

whereby, the vibrating member together with the base plate impart a movement into the thrusters that effect a massaging action while describing a spiraling pattern parallel to and along both sides of the spinal column.

7. The apparatus of claim 5 wherein said vibrating member is supported by said base plate and is slidably captured within slide bearings for fore and aft movement to thereby move the spring board and vibrating member concurrently along a path parallel to the groove;

wherein, the elevating member further includes vertical guides arranged for guiding movement of the spring board towards and away from said base plate and said expansible chamber is a pneumatic cylinder supported by said base plate, to position the thrusters at an elevation that biases the fixture against the spinal area with a predetermined force;

whereby, the vibrating support together with the base plate impart a movement into the thrusters that effect a spiral massaging pattern along either side of the spine.

8. The apparatus of claim 5, wherein said vibrating member is supported by a base plate, said base plate is slidably captured within slide bearings for fore and aft movement to thereby move the spring board and vibrating member concurrently along a path parallel to the groove;

and further including elevating means supported by said base plate to position the thrusters at an elevation that biases the fixture against the spinal area with a predetermined force;

whereby, the vibrating support together with the base plate impart a movement into the thrusters that effect a spiral pattern along the spinal area.

9. Massaging apparatus for massaging a person's back in proximity of the spinal area, said apparatus comprising a main frame member that forms a top surface within which there is supported an elongated vibrating bar; a plurality of thrusters arranged in spaced relationship respective one another, each of said thrusters having a massaging back engaging end opposed to a spring end;

said elongated vibrating bar reciprocatingly receiving each said thruster;

said vibrating mount bar is provided with a pivoted end opposed to an oscillated end wherein the oscillated end is moved with a circular motion while the pivoted end reciprocatingly receives the marginal pivoted end to thereby move each said thruster with a different magnitude of oscillatory motion with the thrusters adjacent the oscillated end of the vibrating mount being moved with the greatest magnitude while the thrusters adjacent the pivoted end of the vibrating bar being moved with a minimum of movement;

a spring support mounted for movement toward and away from said vibrating bar and simultaneously engaging each spring end of said thrusters for moving the massage end of each thruster into engagement with the spinal area of ones back with a selected force that is proportional to the selected distance between the spring support and the vibrating mount;

said spring support is mounted for movement respective to a base plate, said base plate is mounted for movement respective said main frame member, whereby, said base plate moves the spring plate and the vibrating mount bar parallel to the longitudinal axis of the spine to engage the spinal area with massaging action that describes a spiral pattern.

10. The apparatus of claim 9, wherein said vibrating bar has spaced apertures for reciprocatingly receiving a thruster therein.

11. The apparatus of claim 10, wherein said top surface includes a groove extending from a head end opposed to a foot end and along the spinal area for receiving the back engaging end of the thrusters therethrough.

12. The apparatus of claim 11, wherein the pivoted end of said vibrating bar is positioned adjacent the head end of the groove while the oscillated end of the vertical bar is positioned at the foot end of the groove.

13. The apparatus of claim 12, wherein the oscillated end of the bar is vibrated by connecting the foot end of the bar to a crank that is rotated at a relatively fast rotational speed while the head end of the bar is pivotally and reciprocatingly mounted to form the small part of the spiral which increases in size towards the crank.

* * * * *